United States Patent [19]

Meinzer

[11] 4,101,115

[45] Jul. 18, 1978

[54] CRASH CUSHION

[76] Inventor: Lester N. Meinzer, 4331 Sierra Madre Dr., Sacramento, Calif. 95825

[21] Appl. No.: 765,290

[22] Filed: Feb. 3, 1977

[51] Int. Cl.[2] ..... A01F 3/00

[52] U.S. Cl. ..... 256/13.1; 188/1 C; 404/6; 256/1

[58] Field of Search ..... 256/1, 13.1; 188/1 C; 104/254; 404/6, 10

[56] References Cited

U.S. PATENT DOCUMENTS

| | | | |
|---|---|---|---|
| 3,666,055 | 5/1972 | Walker et al. | 188/1 C |
| 3,674,115 | 7/1972 | Young et al. | 256/1 X |
| 3,944,187 | 3/1976 | Walker | 256/13.1 |
| 3,982,734 | 9/1976 | Walker | 256/13.1 |

FOREIGN PATENT DOCUMENTS

| | | | |
|---|---|---|---|
| 2,212,685 | 9/1973 | Fed. Rep. of Germany | 188/1 C |

*Primary Examiner*—Andrew V. Kundrat

*Attorney, Agent, or Firm*—Blair, Brown & Kreten

[57] ABSTRACT

A crash cushion barrier which is a disposable unit that is being used to protect vehicles when striking sign posts, concrete abutments and the like. The crash cushion may consist of a plurality of lightweight containers made of fiberglas and filled with a compressible mixture of vermiculite. The crash cushions are anchored in front of concrete abutments, posts, or guard rails, and if the cushion is hit forceably head-on by a vehicle, the anchor cables will give way and permit the cushion to compress the enclosed vermiculite mixture to a point where movement of the vehicle has been stopped without being destroyed.

6 Claims, 6 Drawing Figures

FIG. 3.
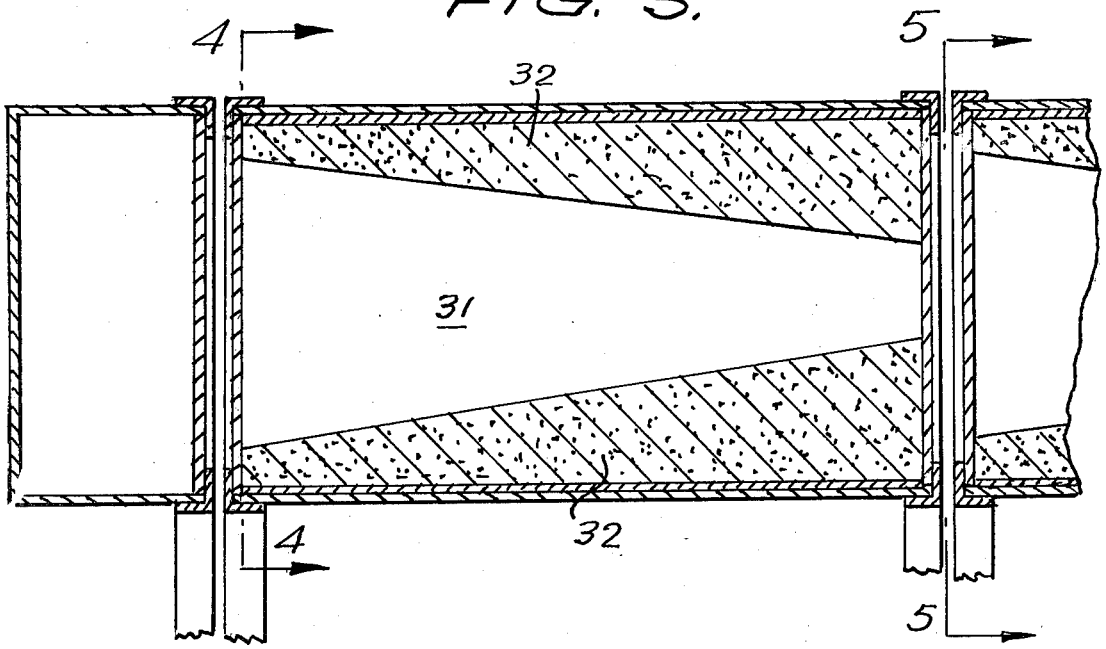
FIG. 4.
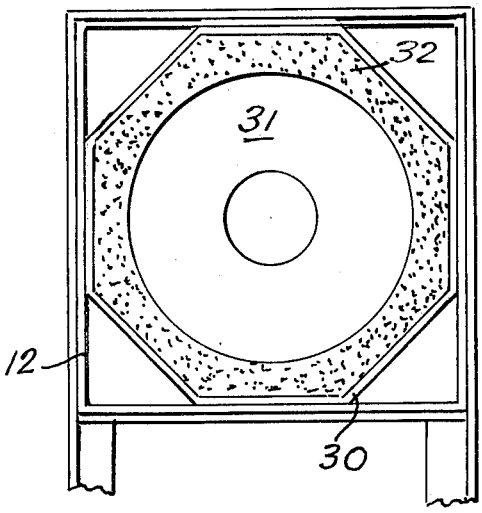
FIG. 5.
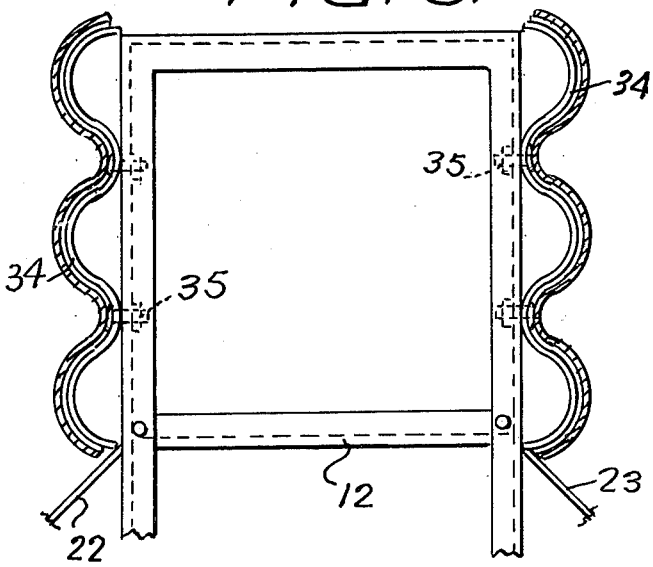
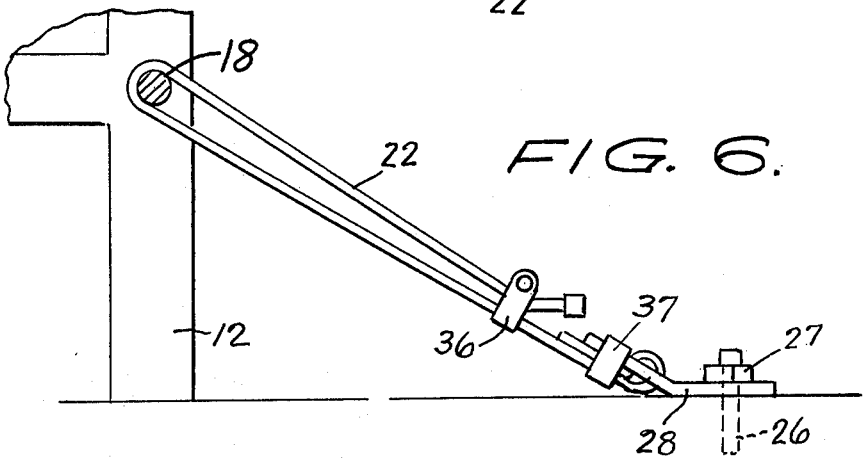
FIG. 6.

CRASH CUSHION

BACKGROUND OF THE INVENTION

1. Field of the Invention

The present invention relates to an economical, disposable unit to be used to protect vehicles from striking concrete abutments, sign posts, or guard rails, as used on many highways.

2. Summary of the Invention

The present invention of a crash cushion includes an economical, disposable unit that is used to be mounted in front of a concrete abutment, sign post, guard rail, or the like, and thereby protect a moving vehicle from annihilation should it strike the abutment, etc. The crash cushion may consist of more than one container, made of fiberglas or plastic, and filled with a compressible mixture of cemented vermiculite. The cushions are ground anchored by means of cables, and if the cushion is hit head-on, the cables will free and the cushion will fold to thereby compress the vermiculite to absorb energy delivered by the vehicle. If the vehicle should strike the cushion from an angle, rather than head-on, cables will slide slightly through the cable clamps for controlling side slip and energy absorption of the vehicle.

The energy absorbing part of the cushion is an octagonal fiberboard container or tube, reinforced with a wrapping of glass fibers or wire, and with a liner of expanded vermiculite particles cemented together to form a crushable material. The center of the liner is hollow and in the shape of a cone, this configuration causing the vermiculite casting to start to crush at the front end and progress toward the rear end as the pressure from the impacting vehicle becomes greater and more is needed to bring the vehicle to a safe stop.

The primary object of the invention is to provide a crash cushion which is used to absorb the energy delivered by a moving vehicle.

Other objects and advantages will become apparent in the following specification when considered in the light of the attached drawings.

BRIEF DESCRIPTION OF THE DRAWINGS

FIG. 3 is a view taken along the line 3—3 of FIG. 1 looking in the direction of the arrows;

FIG. 4 is a view taken along the line 4—4 of FIG. 3 and looking in the direction of the arrows;

FIG. 5 is a view taken along the line 5—5 of FIG. 3 and looking in the direction of the arrows; and FIG. 6 is an elevation view showing an anchoring cable and cable clamp.

DESCRIPTION OF THE PREFERRED EMBODIMENT

Figure 1:
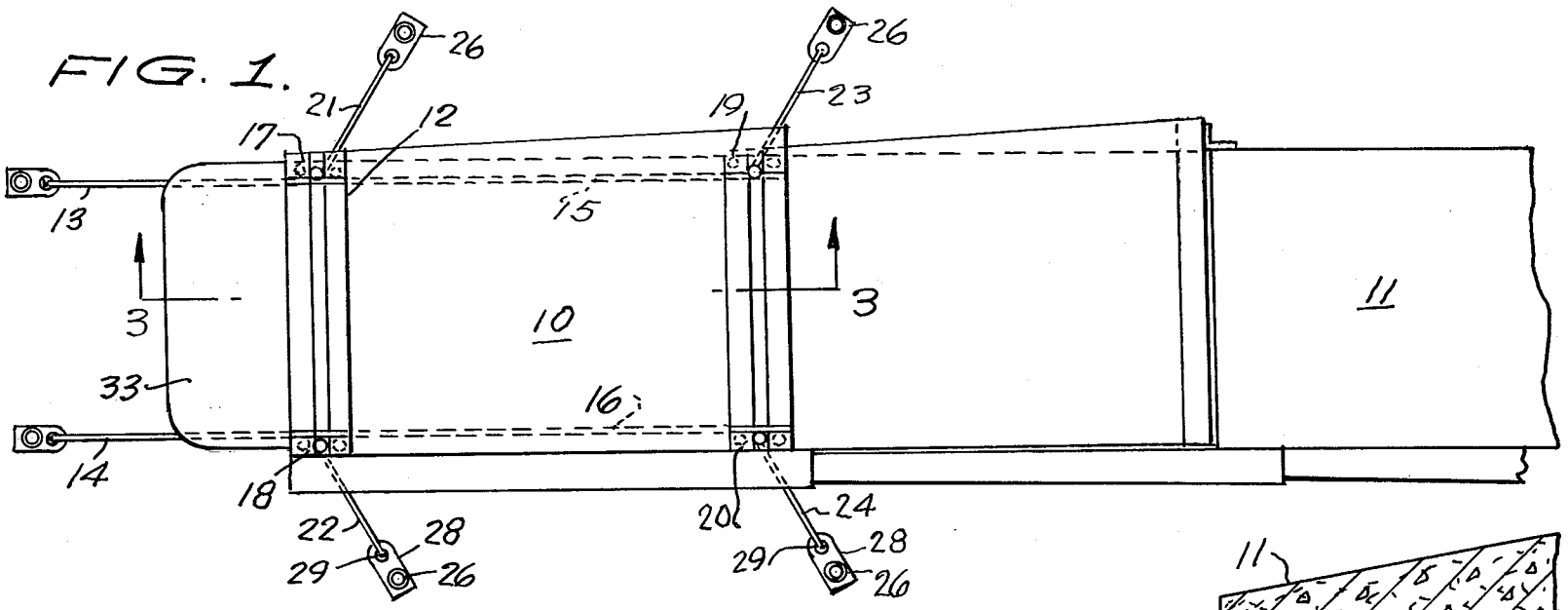
FIG. 1 is an overall plan view of the invention showing more than one crash cushion anchored in place.

Referring now to the drawings, wherein like reference characters indicate like parts throughout the several figures, the reference numeral 10 indicates generally a crash cushion that is mounted before a concrete abutment indicated generally at 11.

The crash cushion 10 is generally supported in a square frame 12, as seen clearly in several of the drawing figures, and where several of the cushions are employed they are placed one behind the other to thereby form a string of cushions before the abutment 11.

To release the cushions as they are compressed there are two cables 13 and 14 extending forward from the first cushion, and 15 and 16 attached to the second cushion, the inner ends of cables 13 and 14 being fastened to pins 17 and 18 which secure the tie-down cables 22 and 21 to frame 12. Cables 15 and 16 are likewise attached to pins 19 and 20 that are parts of the frame for the second cushion.

To support the cushions 10 there are also short cables 21 and 22, at the front unit, and then cables 23 and 24 at a short distance to the second cushion. These cables 21, 22, 23 and 24 are anchored at both sides of the cushions, and at a slight angle toward the rear, so that they can swing in an arc, as the cushion starts to crush from the front, this action allows cables 13 and 14 to pull pins 17 and 18 from frame 12 releasing hold-down cables 21 and 22 so that cushion 10 can then fully compress.

Extending downward into the concrete floor bed 25 there are a plurality of anchored, vertically reaching bolts 26 that have an L-turned, bottom terminal. This particular configuration is chosen so that bolt 26 will be absolutely free from being pulled out of the conrete 25, regardless of applied force.

The top end of bolt 26 is furnished with a threaded nut 27 which is utilized to secure a short plate 28 over bolt 26, the free end of plate 28 having a drilled hole 29 to serve as fastening means for the cable 21, 22, 23 and 24 which is brought to this point, and fastened securely with clamp 37 to prevent any slippage at this point.

The energy absorbing part of this system is an octagonal fiberboard container 30 (FIG. 4) that is located within the square frame 12, and container 30 may be reinforced with a wrapping of glass fibers or wire. Extending along through the center of container 30 there is a hollow, cone shaped space 31, with the large end of cone 31 being at the forward end, and then tapering down to the narrower end at the after terminal.

Around the outside of the cone 31 and thereby filling in the hollow space of the octagonal container there is a mixture of vermiculite particles 32 which are cemented together to form a crushable material.

The center of the liner is hollow and in the shape of a cone, as pointed out before. The walls of this liner (cone) are approximately 2 inches thick on the front end and approximately 6 inches thick at the rear. This configuration causes the vermiculite casting to start to crush at the front end and progress to the rear end as the pressure from the impacting vehicle becomes greater, and more structure is needed to bring the vehicle to a safe stop.

Returning briefly to FIGS. 1 and 2 again it can be seen that the crash cushion 10 has a protecting front end 33 that covers the octagonal section 30, and extends outward slightly in a protective covering. The protective covering 33 may be made of fiberglas, plastic, or other material, and may be filled with soft vermiculite, as a nose piece, fitted to the front of the crash cushion, and which will mold itself to the front of the impacting vehicle, so as to prevent the vehicle from jumping or riding over the top of the crash unit.

In the view of FIG. 5 there is shown a cross section of an rectagonal frame 12, as it would hold the innermost portions of the cone and vermiculite, the framework being anchored by cable assemblies 22 and 23. In this case there is protective means on the outside of the framework in the form of overlapping bridge guide frame 34, which is fastened to frame 12 by means of bolts 35. It has been found that the guide frames 34 serve to protect the frame and reject a vehicle when struck from a side way impact rather than head-on.

The figure given in FIG. 6 is an enlarged and detailed view of an anchoring cable 22, and the manner in which it is looped between frame 12 around pin 18 and then fastened to plate 20 that is screwed down by threaded nut 27. As observed, part of this cable clamping device has a cable clamp 36 tensioned to thereby securely hold the cable, but to slip up the cable if necessary, to allow the crash cushion to move an amount predetermined by cable length and tension setting of the cable clamp 36.

Figure 2:
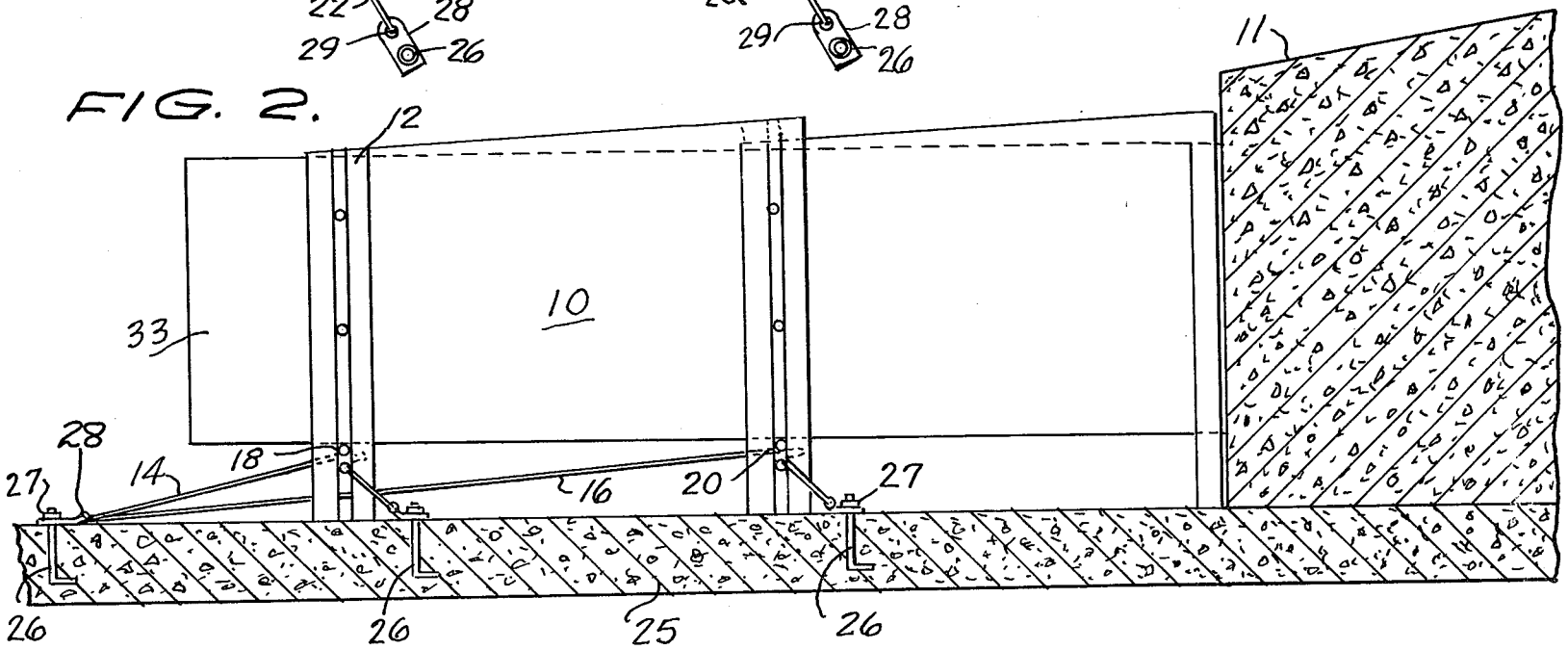
FIG. 2 is an elevation view of more than one crash cushion mounted in front of a concrete abutment.

In the use and operation of the invention a plurality of these crash cushions 10 are placed behind each other in front of a concrete abutment 11, or other means to which a vehicle may hit. In FIGS. 1 and 2 cables 13 and 14 are attached to the release pins 17 and 18 of cushion 10, and stretch forward, and are fastened securely to a bolt 26 and a plate 28 that is screwed down tight by nut 27. Inside the frame 12 there is an octagonal frame 30, in the center of which there is a tapering cone 31 with its large end forward, and small end rear, and there being a mixture of cemented vermiculite around the outer boundary of the cone. Should there be a head-on collision and the first cushion has compressed approximately 30% cables 13 and 14 will pull out pins 17 and 18 releasing anchor cables 21 and 22 freeing the cushion so that it can compress in the direction of the cone to its maximum, the next cushion in line will now start to compress and this chain of events will continue from cushion to cushion until all energy from the vehicle is absorbed. If the collision is from the side rather than head-on, then side cables 21 or 22 will gradually slip in clamp 36 until that energy is also absorbed.

Having thus described the preferred embodiment of the invention it should be understood that numerous structural modifications and adaptations may be resorted to without departing from the spirit of the invention.

What is claimed is:

1. A crash cushion barrier comprising a plurality of cushions aligned in a linear series, one behind the other, means for securing said cushions to a concrete base, a frame disposed within each of said cushions, a tapering conical void within said frame oriented so that its open largest end is at the forward end of the cushion, a compressible material between said conical void and said frame formed from aerated vermiculite plaster of paris and portland cement wherein the frame is octagonal and strengthened by fiberglas threads wrapped around the outside so as to retain the compressible material.

2. The device of claim 1 wherein the means for securing the cushions includes cables bolted down but which will release when the cushions are hit head-on by a vehicle.

3. The device of claim 2 wherein the means for securing the cushions includes cables extending from the front of the cushions and at an angle to both sides of the cushions and the ends secured to concrete base allowing cushion end of cables to swing in an arc as cushion is compressed.

4. The device of claim 3 wherein the anchor cables are released from the cushion after a predetermined amount of compression of cushion.

5. The device of claim 4 wherein the anchor cable is looped around a pin in cushion frame and secured by a cable clamp at a distance from the pin which can be adjusted to slip at a predetermined load.

6. The device of claim 5 wherein the controlled maximum slipping distance is determined by the length of cable looped around the anchor pin.

* * * * *